US005375738A

United States Patent [19]

Walsh et al.

[11] Patent Number: 5,375,738

[45] Date of Patent: Dec. 27, 1994

[54] APPARATUS FOR DISPENSING HEATED FLUID MATERIALS

[75] Inventors: John T. Walsh, Duluth; Timothy M. Hubbard, Canton; Taiwo T. Osinaiya, Stone Mountain, all of Ga.

[73] Assignee: Nordson Corporation, Westlake, Ohio

[21] Appl. No.: 144,893

[22] Filed: Oct. 27, 1993

[51] Int. Cl.[5] ..... B67D 5/62

[52] U.S. Cl. ..... 222/1; 222/146.5; 222/504; 251/129.15; 335/219

[58] Field of Search ..... 222/1, 146.5, 504, 559, 222/146.2; 251/129.01, 129.15; 335/219, 300, 301

[56] References Cited

U.S. PATENT DOCUMENTS

| | | | |
|---|---|---|---|
| 1,504,773 | 8/1924 | Marston . | |
| 3,212,715 | 10/1965 | Cocks . | |
| 3,329,347 | 7/1967 | Montgomery . | |
| 3,408,008 | 10/1968 | Cocks . | |
| 3,463,363 | 8/1969 | Zelna | 222/504 |
| 3,485,417 | 12/1969 | Cocks | 222/504 X |
| 3,485,417 | 12/1969 | Cocks . | |
| 3,593,241 | 7/1971 | Ludwig . | |
| 3,702,683 | 11/1972 | Sturmer . | |
| 3,704,833 | 12/1972 | Wheat . | |
| 3,705,692 | 12/1972 | Garnier . | |
| 3,732,893 | 5/1973 | Ziesche et al. . | |
| 3,811,601 | 5/1974 | Reighard et al. . | |
| 3,827,604 | 8/1974 | Hamilton et al. | 222/146.5 |
| 3,876,177 | 4/1975 | Putschky . | |
| 3,936,030 | 2/1976 | Putschky . | |
| 4,007,880 | 2/1977 | Hans et al. . | |
| 4,153,890 | 5/1979 | Coors | 355/260 |
| 4,218,669 | 8/1980 | Hitchcock et al. . | |
| 4,295,631 | 10/1981 | Allen . | |
| 4,437,488 | 3/1984 | Taggart et al. . | |
| 4,453,652 | 6/1984 | Merkel et al. . | |
| 4,488,665 | 12/1984 | Cocks et al. . | |
| 4,531,679 | 7/1985 | Pagdin . | |
| 4,779,838 | 10/1988 | Greiner et al. . | |
| 4,951,917 | 8/1990 | Faulkner . | |
| 4,962,871 | 10/1990 | Reeves . | |
| 4,981,280 | 1/1991 | Brandenberg . | |
| 4,981,281 | 1/1991 | Brundage et al. . | |
| 5,010,911 | 4/1991 | Grant . | |
| 5,022,629 | 6/1991 | Tibbals . | |
| 5,178,332 | 1/1993 | Tsukakoshi et al. . | |

FOREIGN PATENT DOCUMENTS 2207435 6/1974 France .

OTHER PUBLICATIONS

Nordson ® E-700 Electric Gun, Jun. 1991.

Nordson Corporation Dwg. 00109558; Ref. Dwg. Gun, Electric E-700.

Spraymation, Inc.; Electromatic XX, Multiple Outlet Hot Melt Adhesive Applicator.

Spraymation, Inc.; Thermoplulse Electromatic V, Heated Solenoid Operated Dispensing Head.

Magnetic Circuits and Transformers; p. 95; Massachusetts Institute of Technology; By Members of the Staff of the *Department of Electrical Engineering.*

Plast-O-Matic Valves, Inc.; Digest Catalog 20; Apr. 1992; Quality Engineered Thermoplastic Valves & Controls.

Spraymation, Inc.; Electromatic XV, Solenoid Operated Extrusion Head & Spray Gun.

Spraymation, Inc.; Exclusive Electromatic Head.

*Primary Examiner*—Kevin P. Shaver

*Attorney, Agent, or Firm*—Raymond J. Slattery, III

[57] ABSTRACT

An electromagnetic dispenser (10) for dispensing viscous heated fluids, such as hot melt adhesives. A fixed pole (50) extends from a fluid chamber (20). The coil (46) is located about a portion of the fixed pole (50) and spaced from the fluid chamber to isolate the coil from the fluid flow path of the adhesive. The coil is insulated from the heat which is conducted from the adhesive as well as provided with a heat sink (88) for dissipating heat. A plunger (32) is mounted within the fluid chamber for reciprocal movement therein to open and close dispensing orifice in response to the field generated by the coil.

51 Claims, 5 Drawing Sheets

APPARATUS FOR DISPENSING HEATED FLUID MATERIALS

DESCRIPTION OF THE INVENTION

This invention is directed to a fluid dispenser, such as for the dispensing of viscous fluids, such as adhesives, sealants and caulks. More particularly, this invention is directed to an electromagnetically actuated fluid dispenser for dispensing heated fluid materials such as, for example, hot melt adhesives.

It is common in the dispensing of adhesives to use a pneumatic actuated dispenser, whereby a supply of air is used to move a plunger in reciprocal movement, such that a shutoff needle connected to the plunger is moved from or moved to a seat to permit or stop the dispensing of a pressurized fluid adhesive. To overcome deficiencies of pneumatic dispensers, electromagnetic dispensers have been developed wherein a plunger is driven open by an electromagnetic field and closed by a spring biasing means.

When the coil of an electromagnetic dispenser is energized, the current passing therethrough generates heat due to the resistance of the windings of the coil. Specifically, the heat generated is a function of the current squared and the resistance ($I^2R$) of the windings. As the magnitude of the current passing through the windings increases and/or the length of time the current passing through the windings increases, i.e., longer actuation (on cycle) with a shorter off cycle, more and more heat is generated, thus raising the temperature of the coil. If the heat generated causes the temperature to rise too high, the insulation of the coil may degrade and break down, which may eventually cause the dispenser to fail. This problem is compounded by the fact that in the dispensing of heated fluid materials, such as adhesives commonly known as hot melt adhesives, the fluid material itself may transfer additional heat to the coil. This additional heat increases the temperature of the coil, thus decreasing the allowable temperature rise that can be tolerated by the coil resulting from the current passing through the windings. For example, it is not uncommon for hot melt adhesive application temperatures to be in the range from about 121° C. (250° F.) to about 218° C. (425° F.) or higher. As the application temperature of the adhesive increases, more heat is available to be transferred to the coil. Thus the amount of heat that can be generated by the current passing through the coil in order to avoid exceeding the coil insulation rating is decreased. As such, the allowable energy available to drive the plunger is reduced. This may limit the range of application due to reduced allowable power levels. Furthermore, in some circumstances, the application temperature of the adhesive may even be in excess of the temperature ratings of standard electromagnetic coil designs, making the use of an electrically driven dispenser impractical. On the other hand, hot melt adhesives dispensed at lower temperatures generally transfer less heat to the coil, thus allowing the coil itself to generate more energy (and in turn more heat) before thermal breakdown occurs.

Since the application temperature of the fluid must be maintained, such as to maintain the viscosity of the adhesive at a particular level, heaters are generally provided. Typically cartridge type heaters are provided in the dispenser or the associated service block, thus adding another source which can potentially add heat to the coil.

The problems associated with dissipating the heat generated within the dispenser has resulted in electromagnetic dispensers being larger than standard pneumatic dispenser. This increase in size does not lend this dispenser to be readily useable in multiple configurations, such as mounting a plurality of dispensers side by side to form a bank of dispensers. In many applications, such as carton sealing, it is desirous to apply a plurality of parallel beads to a substrate on fairly close centers. Standard existing pneumatic guns, such as the Nordson ® H200 modules manufactured by Nordson Corporation, are of such a compact size that they are readily adaptable for mounting as a bank of dispensing guns to produce finely spaced beads of material. However, due to the larger size of electromagnetic guns it is difficult to apply closely spaced beads of material to substrates. Furthermore, closely mounting multiple electromagnetic guns together further compounds the problem of heating due to the heat transfer from one dispenser to an adjacent dispenser. For example, if three electromagnetic dispensers are mounted together, the two outer dispensers each add an incremental additional amount of heat to the center dispenser. This additional amount of heat may be sufficient enough to affect the thermal characteristics of the center dispenser, thus causing it to fail or vary in operating performance.

It therefore is desirous to produce a compact electromagnetic dispenser, similar in size to the standard pneumatic dispensers, which is capable of operating at fast cycle rates, and is also capable of operating in a bank of dispenser so that closely spaced apart beads of material may be dispensed onto a substrate. Also, it is desirous to produce an electromagnetic gun which is capable of operating not only at fast cycle rates, but is also capable of handling hot melt adhesives, in particular, those in excess of 300° F.

Some existing designs of electromagnetic dispensers require dynamic seals. Dynamic seals are seals in which an object moves therethrough, such as a plunger, and is used to prevent fluid from migrating past the seal. Eventually, a dynamic seal will lose its sealing properties. Once this occurs, the adhesive may migrate into various portions of the dispenser, causing damage or failure thereto. Therefore, it is also desirous to produce an electromagnetic gun which does not require the use of dynamic seals.

Furthermore, it is desirous to prevent or reduce the heat transfer from the fluid material to the coil to thereby minimize the affect of the heated fluid material on the operating characteristics of the coil. This in turn may extend the life of the coil, while expanding its performance capability, such as, for example, allowing it to operate at faster cycles.

Some hot melt adhesive dispensers have attempted to dissipate the heat generated by the coil by transferring it to the heated adhesive. This transfer, if it occurs at all, is not efficient due to a relatively low temperature differential between the fluid and the coil. Also, it is difficult to actually maintain the fluid at a desired temperature. This is because heat is not applied to, nor sensed directly from, the fluid itself. Rather, heat is applied to a portion of the dispenser and transferred to the fluid. Similarly, heat is sensed at a point in the dispenser itself. As such, the fluid temperature must be less than the thermal rating of the coil.

It therefore is desirous to be able to dispense heated hot melt adhesives from an electromagnetic dispenser, wherein the application temperature of the adhesive may be in excess of the insulation rating of the coil.

SUMMARY OF THE INVENTION

It is therefore an object of the invention, according to one embodiment of the invention, to provide an electromagnetic dispenser which does not require dynamic seals. This may be accomplished, for example, by providing a movable plunger which is located in a fluid chamber or bore in which the movement of the distal end of the plunger from the valve seat, does not extend beyond the fluid chamber or bore in the retracted position. Eliminating the dynamic seal eliminates a wear part which may fail. Thus the potential problem of the dynamic seal failing and allowing heated fluid material to migrate to the coil is eliminated.

It is also an object of the invention according to one embodiment of the invention, to provide an electromagnetic dispenser which has improved performance characteristics.

It is also an object of the invention according to one embodiment, to provide a means for thermally insulating the means for generating the electromagnetic field from the heat transferred from the heated fluid, thus allowing for the dispensing of heated fluid materials having higher application temperatures. For example, under some circumstances this may allow the use of electrical coils having an insulation rating less than the temperature of the heated fluid. This may be accomplished, for example, by spacing the coil away from the heat fluid material. The coil may be spaced from the fluid chamber or bore and an insulating member placed there between. For example, an air gap may be placed between the coil and the fluid chamber to provide a thermal barrier. Alternatively, an insulating material, such as fiberglass, may be used to provide thermal isolation. Similarly, in order to reduce the heat transferred to the coil, it is preferred that the fluid flow path does not extend into the coil region, i.e. the central portion about which the coils are wound.

It is further an object of the invention, according to one embodiment, to provide for dissipating heat generated by, or transfer to, the means for generating the electromagnetic field. This allows the dispenser to operate at higher power levels and/or at higher fluid application temperatures. This may be accomplished, for example, by a heat sink having a plurality of fins for radiating heat therefrom to the ambient air, thermally coupled to the coil for removing heat from the coil. This reduces the operating temperature of the coil, thereby increasing the efficiency of the coil and providing for improved performance at higher power levels/-high cycle rates and/or higher application temperatures.

Up until now, heat sinks have not been used in hot melt dispensers. Since hot melt adhesives are solids at ambient temperatures, they must be heated. As stated previously, heat is applied to the dispenser, either internally or externally, which is then transferred to the adhesive. If the application temperature is exceeded, the adhesive may begin to char which causes the material to produce unwanted solid particulates. If, on the other hand, the temperature falls below the given application temperature, the viscosity of the material will be increased. With increasing viscosity, the fluid material becomes increasingly more difficult to dispense. Changes in viscosity can result in more or less material being deposited onto the substrate, material not being deposited onto the substrate at the appropriate time, the material not shutting off at the appropriate time, and/or improper bonding of the substrate. Also, it is difficult to maintain the appropriate temperature of the hot melt within the dispenser. As a result, the emphasis has been on maintaining the temperature of the adhesive within the dispenser by adding heat and not with the dissipation of such heat from the dispenser to the ambient air.

However, the heat sink provides a means for dissipating the internal heat generated by the coil windings and any heat that may be transferred from the heated fluid material to the windings.

It is also desirous to reduce the vacuum-like attraction force (squeeze film lubrication), that exists between the fixed pole of the coil assembly and the movable plunger, thereby reducing the force necessary to move the plunger to the closed position as well as the time required to close the plunger. This may be accomplished, for example, by providing the movable plunger with an internal flow passage having an opening in the vicinity of the pole/plunger interface.

Some of these and other objects and advantages may be accomplished according to one embodiment by an apparatus for dispensing heated fluid materials comprising: a housing defining a fluid chamber, the fluid chamber extending from a first end to an outlet at a second end; a fixed pole disposed at the first end of the fluid chamber and extending away therefrom, wherein a portion of said fixed pole is in fluid contact with the fluid material within the fluid chamber; an inlet means for coupling the fluid chamber to a source of heated fluid material; a coil for generating an electromagnetic field, disposed about a portion of the fixed pole such that a portion of the pole extends beyond the coil to space the coil from the first end of the fluid passageway; and a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet.

Still further, some of these and other objects and advantages may be accomplished according to another embodiment by an apparatus for dispensing heated fluid materials comprising: a housing defining a fluid chamber; an inlet means coupled to the fluid chamber for receiving heated fluid material; an outlet means, coupled to the fluid chamber for dispensing heated fluid material therefrom; a plunger means disposed within the fluid chamber and mounted for reciprocal movement therein between a closed position and an open position for opening or closing the outlet means; a fixed pole, mounted adjacent to the plunger; a coil means, disposed about a portion of said fixed pole, for generating an electromagnetic field and inducing magnetic poles in the fixed pole and the plunger; means for thermally insulating the coil means from the fluid chamber; and means coupled to the coil means, for dissipating heat from said coil means.

Still further, some of these and other objects and advantages may be accomplished according to an embodiment of the invention by an apparatus for dispensing heated fluid materials comprising: an inlet means for receiving the heated fluid materials; a means for generating an electromagnetic field; an outlet means, coupled to the inlet means, for dispensing said heated fluid materials therefrom; a means movable from a first position to a second position in response to the generated electromagnetic field, wherein the dispensing of said heated fluid material is blocked in said first position and wherein said heated fluid material flows from said outlet means in said second position; and a heat dissipating means for removing heat from the means for generating the electromagnetic field.

Still further, some of these and other objects and advantages may be accomplished according to an embodiment of the invention by an apparatus for dispensing hot melt adhesive comprising: a housing defining a fluid chamber; an inlet means for coupling the fluid chamber to a source of hot melt adhesive; a fixed pole extending into said fluid chamber such that a portion of an external surface of said fixed pole is in fluid communication with the adhesive; a coil for generating an electromagnetic field, disposed about a portion of the fixed pole and spaced from said fluid chamber; an insulating means, disposed between said fluid chamber and said coil for insulating the coil from the fluid chamber; a plunger disposed within the fluid chamber and mounted for reciprocal movement between a closed position and an open position, said plunger comprising a first portion, having a diameter closely approximating a diameter of the fluid chamber, and a second portion having a reduced diameter and extending from the first portion, the second portion including an engaging means for mating with a surface in the closed position, said plunger being spaced from said fixed pole in said closed position and adjacent to said fixed pole in said open position; at least one bypass flow channel, carried by said housing, for allowing the adhesive to flow past the first portion of the plunger; a means for biasing the plunger in the closed position; a discharge opening coupled to said fluid chamber; and wherein, in response to said electromagnetic field, the plunger moves from the closed to the open position such that adhesive is dispensed therefrom.

DESCRIPTION OF THE DRAWINGS

The following is a brief description of the drawings in which like parts may bear like reference numerals and in which.

DEFINITIONS

Figure 1:
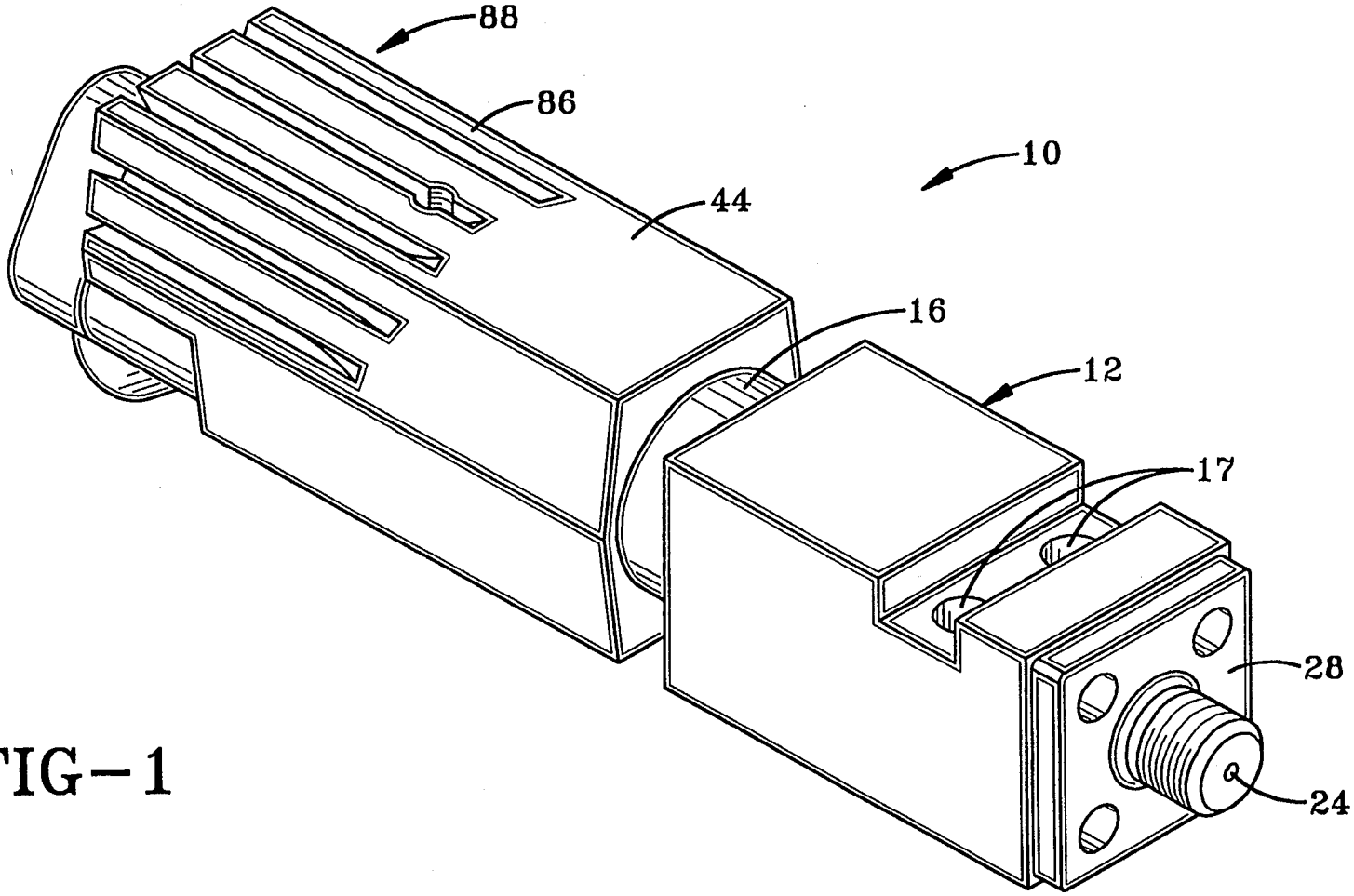
FIG. 1 is a perspective view of a dispenser in accordance with one embodiment of this invention.
Figure 2:
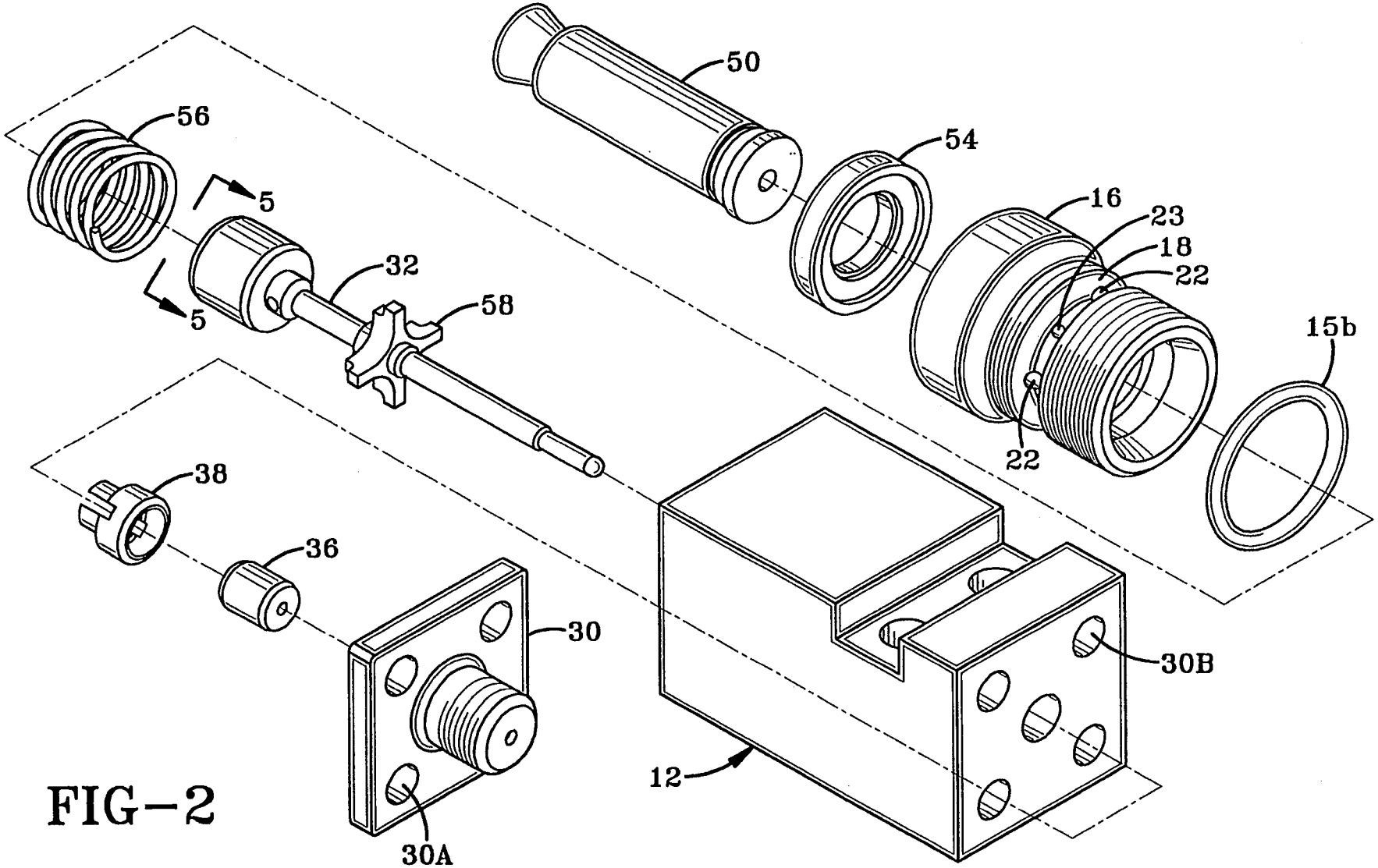
FIG. 2 is a partial exploded view of the dispenser of FIG. 1.

The following definitions are applicable to this specification, including the claims, wherein;

"Axial" and "Axially" are used herein to refer to lines or directions that are generally parallel to the axis of reciprocal motion of the plunger of the dispenser.

"Inner" means directions toward the axis of motion of the plunger and "Outer" means away from the axis of motion of the plunger.

"Radial" and "Radially" are used to mean directions radially toward or away from the axis of motion of the plunger.

DETAILED DESCRIPTION OF THE INVENTION

For the purpose of the present discussion, the method and apparatus of this invention is described in connection with the dispensing of a hot melt polymeric material used in adhesive applications. Hot melt materials are those materials which are solid at room or ambient temperature but, when heated, are converted to a liquid state. It should be understood that the methods and apparatus of this invention are believed to be equally applicable for use in connection with the dispensing of other heated fluid materials.

Now, with reference to the figures, there is illustrated a dispenser, shown generally by reference numeral 10 according to one embodiment of this invention. The dispenser 10 includes a dispenser body 12, having an inlet 14 for receiving a source of fluid material, such as a hot melt adhesive. For example, inlet 14 may be attached to a service module (not shown) having fluid passages therein for supplying fluid and containing heaters and temperature sensors to maintain the temperature of the fluid entering inlet port 14. An O-ring **15*a* mounted within inlet port 14. The dispenser 10 may be mounted to the service block by mounting screws 17**.

Mounted within a cavity of the body 12 is an adapter body 16. The adapter body 16 has an outer annular groove 18, which is coupled to the inlet 14. The adapter body and the dispenser body form a fluid chamber 20. An O-ring **15*b* may be used to provide a seal between the adapter and dispenser bodies 16, 12. Fluid is transferred from the annular groove 18 to the fluid chamber 20 by fluid passageways 22 and 23. The fluid chamber 20 is coupled to the discharged outlet 24 via an axially extending fluid passageway 26**.

Attached to the dispenser body 12 is a nozzle adapter 28. The nozzle adapter may be mounted to the dispenser body by screws (not shown) extending through openings 30A, 30B, respectively. The outer periphery of the nozzle adapter 28 may have threads 31 for receiving a nozzle, not shown.

Located within the fluid chamber 20 and the fluid passageway 26 is a plunger 32, which is slidably mounted for reciprocal motion. The plunger 32 has a valve needle 34, such as a ball, located at one end of the plunger 32 for mating with a seat 36, located within the nozzle adapter 28, in the closed position. An insert 38 aligns the seat 36 and the nozzle adapter 28 with the fluid passageway 26 in dispenser body 12. Alternatively, the insert 38 may have point guide contacts, for guiding the plunger into the seat 36 as the plunger 32 moves from an open position to a closed position.

An electromagnetic coil assembly 42 is enclosed by housing 44. The electromagnetic coil assembly generates an electromagnetic field when it is subjected to a source of electrical power (not shown). The electromagnetic coil assembly 42 includes a coil 46 comprising a plurality of windings wrapped around a bobbin or spool 48. The windings of the coil 46 may be encased in a potting layer. Preferably this potting material has a high thermal conductivity in order to transfer the heat generated by the coil to the housing 44, for eventual dissipation to the surrounding ambient air.

The spool 48 is located around a pole piece 50 and may be attached to one another, such by potting. The pole piece 50 is generally cylindrical in shape having an end 52 in fluid communication with the fluid chamber 20. Preferably the pole piece 50 extends axially from the spool such that the spool is spaced from the fluid chamber 20. A ring 54 may be located about the periphery of and brazed to, the pole piece 50 to maintain the spacing between the pole piece and the adapter body 16. The interaction of the pole piece 50, ring 54 and the adapter body 16 provide a seal to prevent the flow of fluid material from contacting the spool and in turn the coil 46. It is necessary that the ring 54 is of a material which is non-magnetic so as to help prevent the magnetic field from passing through it. The ring 54 also provides spacing between the coil and the adapter body. It is therefore preferred that the ring 54 does not readily transfer heat therethrough so as not to readily transfer heat to the coil. It has been found that a ring 54 manufactured out of 300 series stainless steel performs these functions adequately. It is also preferred, to provide further insulation between the coil and the heated fluid in order to further limit the transfer of heat to the coil. This can be accomplished by providing an air gap 55 between the ring 54 and the spool 48. For example, the spool 48 may include a raised annular portion 48A to provided spacing between the spool and the ring 54. This spacing results in an air gap directly between the spool and the ring 54, and indirectly between the spool and the fluid chamber. Thus the windings of the coil 46 are both physically and thermally isolated from the fluid material. As an alternative to utilizing air, other insulation materials, such as fiberglass, for example, can be used to help insulate the coil.

The pole piece 50 is a fixed pole. In other words, when the coil 46 is energized it is not driven axially but is retained in its position. In contrast, the plunger 32 is a movable member.

Upon energization of the coil 46, the generated magnetic field will establish a pole (north or south) on the end 52 of the pole 50. Likewise, a pole of opposite polarity to that established on end 52 of pole 50 will be established on the head 62 of the plunger 32. This will cause plunger 32 to be attracted to the fixed pole 50. As the plunger 32 moves toward the fixed pole 50 the valve needle 34 is moved from the seat 36 which allows the adhesive to be dispensed from the outlet 24. When the coil is de-energized and the field collapses, the plunger 32 will be moved back to the closed position by a spring 56. The spring 56 extends between arms of a retainer 58, attached to the plunger 32, and a shoulder 60 of the adapter body 16.

The head 62 of the plunger 32 has a diameter which closely approximates that of the diameter of the fluid chamber in the portion in which the head 62 slidably moves. This helps to keep the plunger properly aligned as it slides back and forth. While a close fit provides for good guiding of the plunger, it does not provide a good flow path for the material. Therefore, in order to allow for the fluid material to flow past the head, bypass channels 64 are provided in the adapter body.

Causing the fluid to flow past the plunger in this manner helps to prevent dead spots from occurring in the flow of the adhesive through the dispenser. With dead spots, the fluid may begin to solidify to produce undesirable particles or chunks, commonly know as char. Under some circumstances, the flow path through channels 22 and around the plunger head via channels 64, may result in excessive pressure drops across the plunger. In such instances, the pressure drop across the head of the plunger may be reduced by shunting some of the adhesive directly into the fluid chamber 20 from the outer annular groove 18 via channels 23.

When dispensing, the face 70 of the head 62 of the plunger 32 will be adjacent to and/or in contact with the end 52 of the fixed pole 50. Fluid material trapped between face 70 of the plunger head 62 and the end 52 of the fixed pole will contribute to an increase in the force required to begin to move the plunger to the closed position and/or will cause the closing response time to increase. This phenomenon is similar to the increase in force that is required to separate two pieces of glass which have a drop of fluid placed in between them. As used herein, this phenomenon will be referred to as squeeze film lubrication.

It has been previously known to provide a raised annular ring to the face of the plunger in order to minimize the contact area between the plunger and the fixed pole in order to reduce the effect of squeeze film lubrication. See, for example, U.S. Pat. No. 4,951,917 to Faulkner, the disclosure thereof, is incorporated herein by reference. However, while such an annular ring could be employed here, it is believed to be preferable to use several raised portions 72 spaced about the pole face 70 of the plunger 32. Not only does this reduce the squeeze film lubrication force, but also provides a means for reducing the residual magnetism within the plunger. This is accomplished by reducing the cross-sectional area in contact between the pole face 52 of the pole 50 and the face 70 of the head 62 of the plunger 32.

Furthermore, in order to further help reduce the effect of squeeze film lubrication, it has been found to be beneficial to provide a means for introducing a flow of fluid between the pole 50 and the plunger 32 to provide vacuum relief. This may be accomplished by providing the head 62 with fluid flow channels 66, 68. Flow channel 66 extends axially from the face 70, closest to the pole 50. Intersecting with this channel is a radially extending channel 68 which opens into the chamber 20.

As the plunger 32 begins to move toward the closed position fluid will be directed into the openings of fluid channel 68, into fluid channel 66, and eventually into the area 74, which is formed between the fixed pole 50 and the plunger head 62, as well as between the raised portions 72. The introduction of fluid into area 74 from channels 66 and 68 reduces the vacuum like attraction force between the pole and the plunger as the plunger is being driven to the closed position.

Furthermore, this flow path 66, 68 helps in decreasing the response time necessary to move the plunger to the open position. As the plunger moves from the closed to the open position, there is fluid between the head 62 of the plunger and the fixed pole piece 50 which must be displaced. The head, acting much like a piston will displace fluid through the bypass channels 64, as well as through flow channels 66 and 68, and into the fluid chamber 20. Also, the amount of fluid which must be displaced is now the volume of fluid contained within the area 74.

Fixed pole 50 may be provided with a bore 76. Contained within this bore is a non-magnetic material, such as 300 series stainless steel, brass, etc., which effectively prevents the adhesive from traveling into the interior of the fixed pole. The non-magnetic material within the bore 76 helps concentrate the magnetic flux generated by the coil on the pole face 52 of the pole 50 by reducing the cross-sectional area of the magnetic portion of the pole 50 which is perpendicular to the lines of flux. The coil assembly 42 may be retained within the assembly by a set screw 78.

The windings of the coil 46 may be coupled to a source of electrical power by electrical conductors passing through a bore (not shown) to a respective electrical stud, such as illustrated at 80. Each of the studs 80, connect to female couplings 81 carried by an electrical connector 83. The female couplings 81 may be connected to the electrical conductors (not shown) of a cord set extending from port 82. The connector 83 may be retained to the coil housing by a screw 84.

Figure 3:
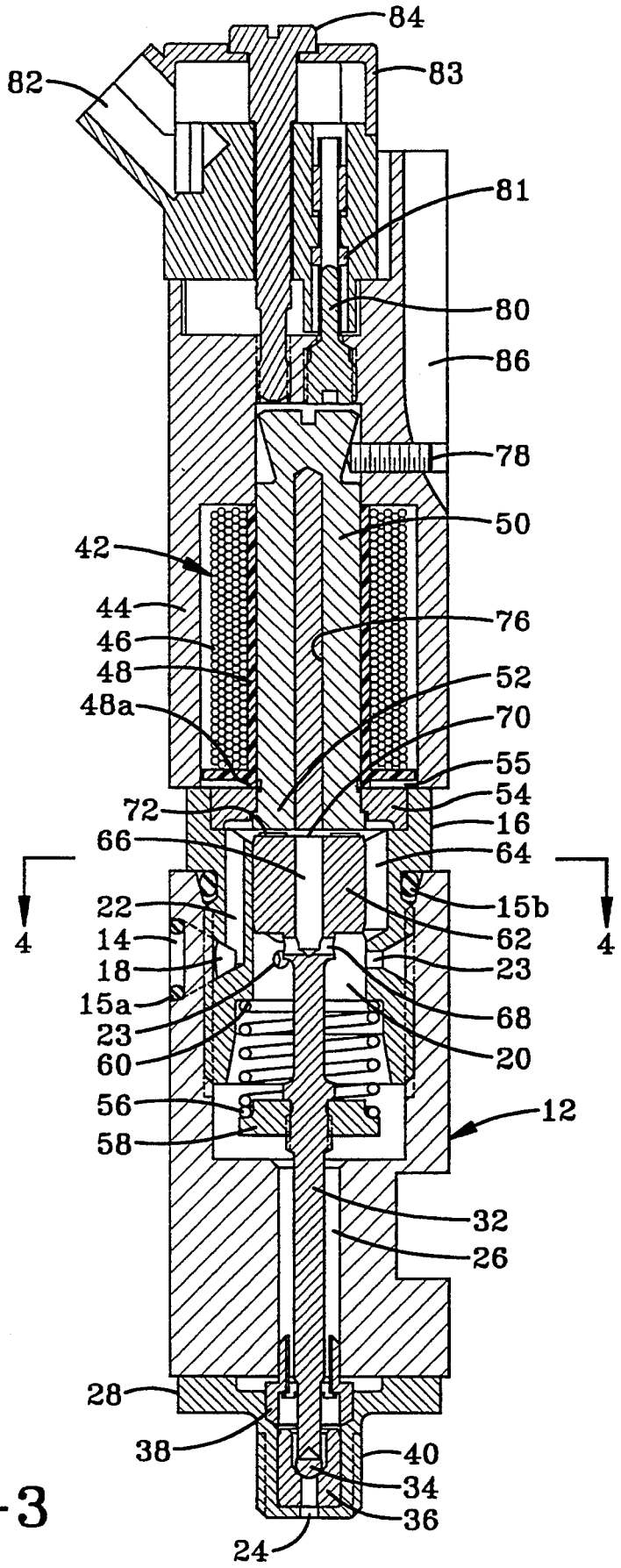
FIG. 3 is an elevational cross-sectional view of the dispenser of FIGS. 1 and 2.
Figure 4:
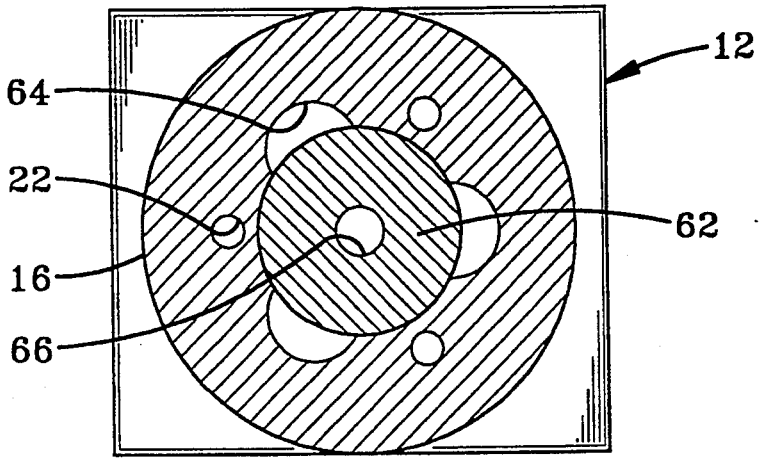
FIG. 4 is a cross-sectional view taken substantially along line 4—4.
Figure 5:
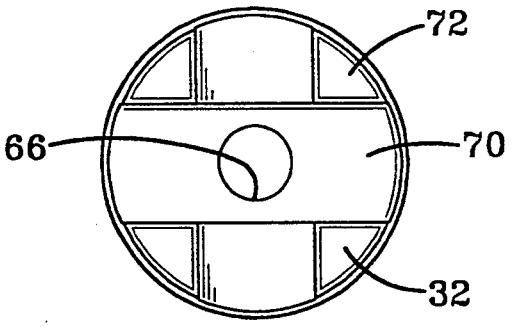
FIG. 5 is an end view of the plunger 32 taken along lines 5—5.
Figure 6:
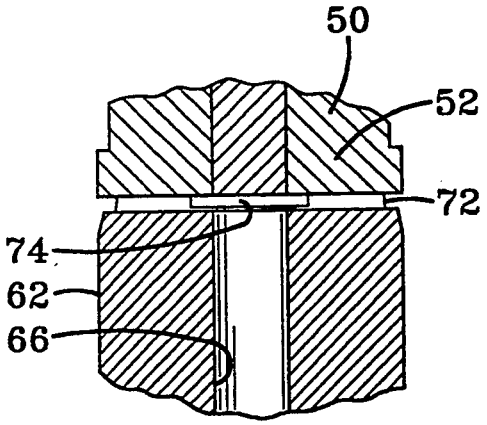
FIG. 6 is an enlarged view of the interface between the fixed pole and the plunger in the retracted position.

In order to more effectively and efficiently dissipate the heat within the dispenser, it is preferred to provide the dispenser with heat sinks. For example, coil housing 44 may be provided with a plurality of fins 86 for dissipating the heat generated within the dispenser. The fins 86 of the heat sink 88 are thermally coupled to electromagnetic coil assembly 42. In the embodiment viewed in FIG. 3, heat generated by the coil assembly 42 will be thermally transferred through the coil housing 44 and to the fins 86. In that the coil housing 44 directs heat away from the coil assembly 42, it is preferred that it is of a material that is fairly thermally conductive. Furthermore, it is preferred that coil housing 44 is also of a material which will help direct the field generated by the coil 46. In other words, it is preferred that the housing is of a magnetic material, such as a ferro magnetic material. While the heat sink and the housing 44 may be one piece, they could be two separate pieces. For example, a dispenser has been built wherein good results have been obtained with aluminum heat sinks attached to the coil housing 44.

In that it is desirous to keep the heat generated by the coil to a minimum, reducing the magnitude of the current passing through the coil will, therefore, help reduce the amount of heat generated by the coil. Once the plunger has moved to its full open position, the magnitude of the current passing through the coil may be reduced to a lower hold in current. In other words, current may be sent to the coil in order to generate an electromagnetic field which quickly drives the plunger from the closed to the open position. However, once in the full open position, the amount of current required to maintain the plunger at that position is less than it takes to drive it from the closed to the open position. There are several different driving methods which can attain this result. For example, U.S. Pat. No. 4,453,652 (Controlled Current Solenoid Driver Circuit), the disclosure of which is incorporated herein by reference, which is assigned to the assignee of this invention, describes a method of reducing the current flow through a coil once the plunger has moved to its fully extended position. Other current driving schemes could also be used which help reduce the power requirements of the coil.

Figure 7:
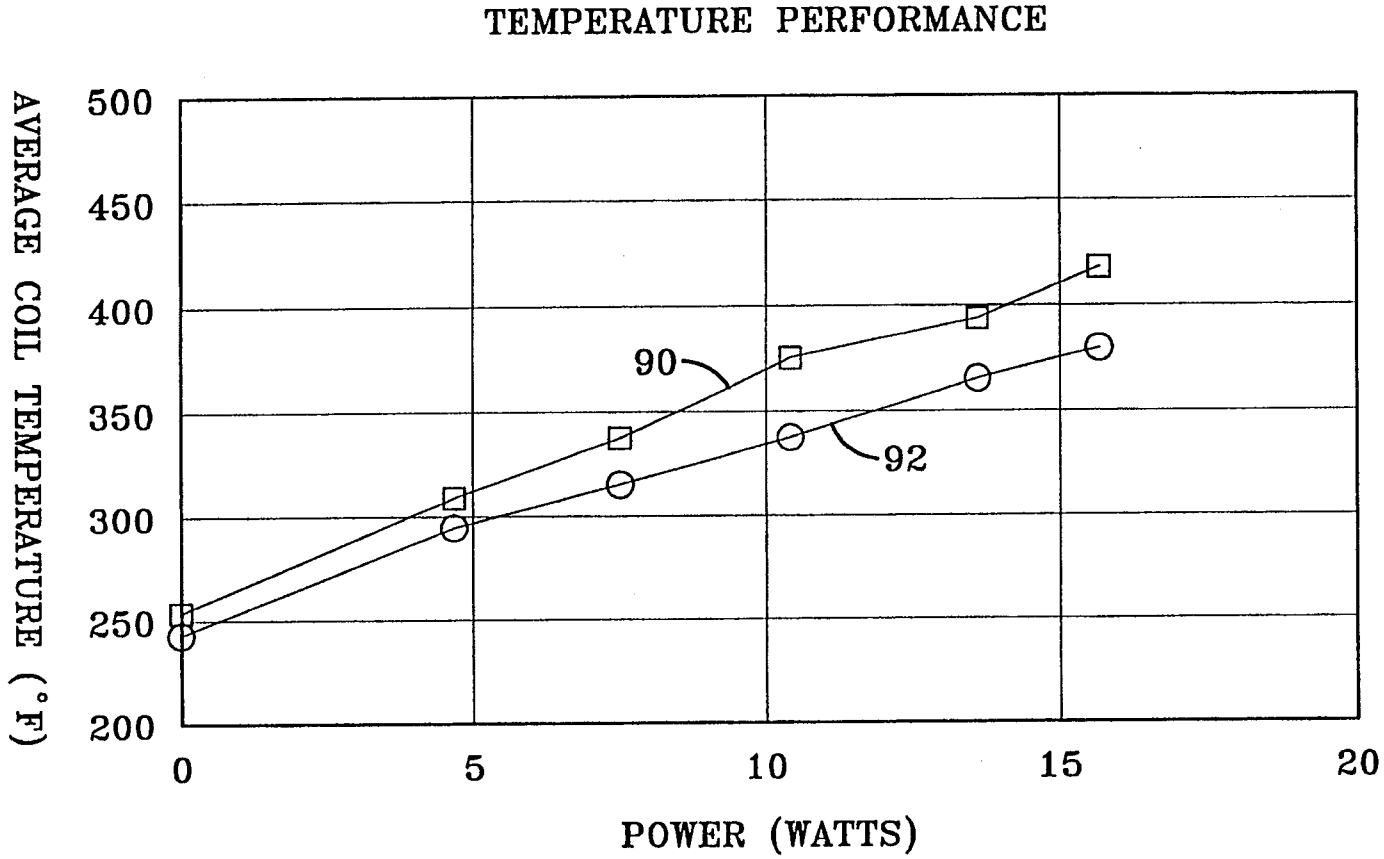
FIG. 7 is a graph of temperature versus power.

An experiment was conducted to compare the heat dissipating characteristics of a dispenser with and without a heat sink. With reference to FIG. 7, there is illustrated a graph of the temperature of the coil of an electric dispenser versus the power utilized by the coil. The electric dispenser according to an embodiment of the invention, was equipped with detachable aluminum heat sinks. The temperature of the coil was monitored at various power levels both with and without the heat sinks attached to the housing of the dispenser. The application temperature of the adhesive during this experiment was 355° F. while the ambient temperature was approximately 70° F. The temperature plotted on each curve is an average of all temperatures taken at that particular power level.

The graph of the temperature without heat sinks is illustrated by line 90 while that of the temperature with heat sinks is illustrated by line 92. As the power of the coil increases, the temperature differential between the two lines becomes generally greater. Thus, at higher power levels, the benefit of the heat sinks becomes more and more apparent. Being able to operate at higher power levels allows the coil to be driven open/closed faster, thereby allowing the dispenser to operate at faster cycle times.

Also, since the plunger is a ferromagnetic material, such as steel, it is preferable to match the thermal expansion coefficient of the various parts which the plunger inter-reacts with, such as the body 12, seat, etc. Due to the heat fluid material and/or its associated heaters, these materials are going to expand. At higher application temperatures this expansion becomes greater. If aluminum is used, for the body, it will expand faster than that of the plunger. This may cause air gap variations. Therefore, it is preferred that the body 12 and the plunger 32 are made from the same materials or from materials which have the same or close coefficients of thermal expansions.

Manufacturing the body 12 and the adapter body 16 out of stainless steel not only helps maintain the magnetic air gap at varying temperatures, but also allows for a more compact unit. In that hot melt adhesive dispensing systems can operate at relatively high pressures, such as for example, between 1000–1500 psi, the bodies 12 and 16 must be able to withstand such pressures. Bodies manufactured from aluminum would require greater cross-sectional areas than those manufactured from steel. As a result, a smaller and more compact unit may be produced by utilizing steel for the bodies 12 and 16.

While certain representative embodiments and details have been shown for the purpose of illustrating the invention, it will be apparent to those skilled in the art that various changes and modifications can be made therein without departing from the scope of the invention.

It is claimed:

1. The method of dispensing a heated polymeric material comprising the steps of:

directing the flow of said polymeric material through a bore containing a plunger slidably mounted and contained therein;

directing the flow of said polymeric material about a portion of a non-movable pole extending from said bore;

reducing the transfer of heat to a coil means, disposed about a portion of the pole, for generating an electromagnetic field; and generating an electromagnetic field for effectuating a movement of the plunger from a closed to an open position such that the polymeric material is directed past the plunger and discharged from a discharge orifice.

2. The method of claim 1 further comprising the step of:

transferring heat from the coil means to the ambient air.

3. The method of claim 1 wherein the temperature of the coil means is maintained at a temperature less than that of the heated polymeric material.

4. The method of claim 1 further comprising the steps of:

de-energizing the electromagnetic field; and reducing the attraction forces between the plunger and a face of the pole.

5. The method of claim 1 further comprising the step of concentrating the magnetic flux generating by the coil means on a portion of the pole adjacent to the plunger.

6. The method of claim 1 further comprising the step of:

maintaining a constant magnetic air gap between the plunger and an inner diameter of said bore.

7. The method of dispensing a heated polymeric material comprising the steps of:

directing the flow of said polymeric material through a bore containing a plunger slidably mounted and contained therein;

causing a coil assembly to generate an electromagnetic field for effectuating a movement of the plunger from a closed to an open position, such that the polymeric material is directed past the plunger and discharged from a discharge orifice; and transferring heat from the coil assembly to the ambient air.

8. The method of claim 7 further comprising the steps of:

concentrating the magnetic flux generated on a portion of a pole, of the coil assembly, adjacent to the plunger;

de-energizing the electromagnetic field; and then reducing the attraction forces between the plunger and the pole.

9. An apparatus for dispensing heated fluid materials comprising:

a housing defining a fluid chamber, the fluid chamber extending from a first end to an outlet at a second end;

a fixed pole disposed at the first end of the fluid chamber and extending away therefrom, wherein a portion of said fixed pole is in fluid contact with the fluid material within the fluid chamber;

an inlet means for coupling the fluid chamber to a source of heated fluid material;

a coil for generating an electromagnetic field, disposed about a portion of the fixed pole such that a portion of the pole extends beyond the coil to space the coil from the first end of the fluid chamber; and a plunger disposed within the fluid chamber adjacent to the fixed pole and mounted for reciprocal movement therein between closed and retracted positions when subjected to said electromagnetic field, such that when said plunger is in said closed position the outlet is blocked to prevent fluid flow therefrom and in said retracted position fluid flow is emitted from the outlet.

10. The apparatus of claim 9 further including a means for reducing the transfer of heat from the heated fluid material to the coil.

11. The apparatus of claim 9 further comprising a means for reducing a pressure drop across a portion of the plunger.

12. The apparatus of claim 9 further including a heat sink means, thermally coupled to said coil for dissipating heat from the coil.

13. The apparatus of claim 9 further comprising a means for maintaining a magnetic air gap at varying temperatures.

14. The apparatus of claim 9 further comprising:

a biasing means for biasing the plunger means in the closed position and wherein upon energization of the coil, the biasing of the plunger is overcome and the plunger is moved to the retracted position.

15. The apparatus of claim 14 further including a means for reducing the transfer of heat from the heated fluid material to the coil.

16. The apparatus of claim 14 further including a heat sink means, thermally coupled to said coil for dissipating heat from the coil.

17. The apparatus of claim 9 wherein the plunger includes a means to reduce squeeze film lubrication forces between said plunger and said fixed pole.

18. The apparatus of claim 17 further including a heat sink means, thermally coupled to said coil for dissipating heat from the coil.

19. The apparatus of claim 9 wherein the plunger includes a means for reducing residual magnetism.

20. The apparatus of claim 19 further including a means for reducing the transfer of heat from the heated fluid material to the coil.

21. The apparatus of claim 19 further including a heat sink means, thermally coupled to said coil for dissipating heat from the coil.

22. The apparatus of claim 9 further including a heat sink means, thermally coupled to said coil for dissipating heat from the coil; and a means for reducing the transfer of heat from the heated fluid material to the coil.

23. The apparatus of claim 22 wherein said means for reducing the transfer of heat is an air gap.

24. The apparatus of claim 9 wherein the plunger comprises:

a head portion having a diameter closely approximating the size of the fluid chamber and a reduced portion extending therefrom, the reduced portion including engaging means for mating with a surface in the closed position.

25. The apparatus of claim 24 wherein the plunger and at least a portion of the housing have similar coefficients of thermal expansion.

26. The apparatus of claim 25 wherein the plunger and the housing are steel.

27. The apparatus of claim 24 wherein said housing includes at least one bypass flow channel for providing a fluid path past the head portion of the plunger.

28. The apparatus of claim 27 further including a means for reducing the transfer of heat from the heated fluid material to the coil.

29. The apparatus of claim 27 further including a heat sink means, thermally coupled to said coil for dissipating heat from the coil.

30. The apparatus of claim 24 wherein the plunger includes a head portion having a face adjacent said fixed pole and a fluid passageway extending from said face to said fluid chamber for allowing the passage of the fluid materials therethrough.

31. The apparatus of claim 30 further including a means for reducing the transfer of heat from the heated fluid material to the coil.

32. The apparatus of claim 30 further including a heat sink means, thermally coupled to said coil for dissipating heat from the coil.

33. The apparatus of claim 30 wherein said housing includes at least one bypass flow channel for providing a fluid path past the head portion of the plunger.

34. The apparatus of claim 33 wherein said inlet means includes a fluid passageway having an opening in the vicinity of the fixed pole.

35. The apparatus of claim 33 wherein the plunger and at least a portion of the housing have similar coefficients of thermal expansion.

36. An apparatus for dispensing heated fluid materials comprising:

a housing defining a fluid chamber;

an inlet means coupled to the fluid chamber for receiving heated fluid material;

an outlet means, coupled to the fluid chamber for dispensing heated fluid material therefrom;

a moveable means disposed within the fluid chamber and mounted for reciprocal movement therein between a closed position and an open position for opening or closing the outlet means;

a fixed pole, mounted adjacent to the moveable means;

a coil means, disposed about a portion of said fixed pole, for generating an electromagnetic field and inducing magnetic poles in the fixed pole and the moveable means;

means for thermally insulating the coil means from the fluid chamber; and means coupled to the coil means, for dissipating heat from said coil means.

37. An apparatus for dispensing heated fluid materials comprising:

an inlet means for receiving the heated fluid materials;

a means for generating an electromagnetic field;

an outlet means, coupled to the inlet means, for dispensing said heated fluid materials therefrom;

a means movable from a first position to a second position in response to the generated electromagnetic field, wherein the dispensing of said heated fluid material is blocked in said first position and wherein said heated fluid material flows from said outlet means in said second position; and a heat dissipating means for removing heat from the means for generating the electromagnetic field.

38. The apparatus of claim 37 wherein said heat dissipating means comprises a housing having a plurality of external fins and wherein said means for generating the electromagnetic field is disposed within said housing.

39. The apparatus of claim 37 further comprising a means for maintaining a magnetic air gap at varying temperatures.

40. The apparatus of claims 37 further comprising means for thermally insulating the means for generating an electromagnetic field from heat transferred from the heated fluid material.

41. The apparatus of claim 40 wherein the temperature of the means for generating an electromagnetic field versus operating power corresponds substantially to that of FIG. 7.

42. The apparatus of claim 37 wherein said heat dissipating means is a heat sink.

43. The apparatus of claim 42 wherein said heat sink includes a plurality of fins thermally coupled to said means for generating the electromagnetic field.

44. The apparatus of claims 43 further comprising means for thermally insulating the means for generating an electromagnetic field from heat transferred from the heated fluid material.

45. An apparatus for dispensing hot melt adhesive comprising:

a housing defining a fluid chamber;

an inlet means for coupling the fluid chamber to a source of hot melt adhesive;

a fixed pole extending into said fluid chamber such that a portion of an external surface of said fixed pole is in fluid communication with the adhesive, but preventing the flow of said hot melt adhesive through said pole;

a coil for generating an electromagnetic field, disposed about a portion of the fixed pole and spaced from said fluid chamber;

an insulating means, disposed between said fluid chamber and said coil for thermally insulating the coil from the fluid chamber;

a plunger disposed within the fluid chamber and mounted for reciprocal movement between a closed position and an open position, said plunger comprising a first portion, having a diameter closely approximating a diameter of the fluid chamber, and a second portion having a reduced diameter and extending from the first portion, the second portion including an engaging means for mating with a surface in the closed position, said plunger being spaced from said fixed pole in said closed position and adjacent to said fixed pole in said open position;

at least one bypass flow channel, carried by said housing, for allowing the adhesive to flow past the first portion of the plunger;

a means for biasing the plunger in the closed position;

a discharge opening coupled to said fluid chamber; and wherein, in response to said electromagnetic field, the plunger moves from the closed to the open position such that adhesive is dispensed therefrom.

46. The apparatus of claim 45 further comprising a means for dissipating heat from the coil.

47. The apparatus of claim 45 further comprising a heat sink thermally coupled to said coil.

48. The apparatus of claim 45 further comprising a means for reducing the attraction between the fixed pole and the plunger as the plunger moves from the open to the closed position.

49. The apparatus of claim 45 wherein said inlet means comprises:

an inlet for receiving said adhesive from said source;

a first flow channel coupled to said inlet for discharging said adhesive into said fluid chamber in the vicinity of said fixed pole; and a second flow channel coupled to said inlet for discharging said adhesive into said fluid chamber in the vicinity of the second portion of said plunger.

50. The apparatus of claim 45 wherein the first portion of the plunger includes a passageway extending away from a face adjacent to said fixed pole to an opening communicating with said fluid chamber.

51. The apparatus of claim 50 further including a means for concentrating the magnetic flux generated by the coil on a portion of the fixed pole adjacent to the first portion of the plunger.

* * * * *